US008959793B2

(12) United States Patent
Zea et al.

(10) Patent No.: US 8,959,793 B2
(45) Date of Patent: Feb. 24, 2015

(54) PIN OVEN WITH A CONTINUOUS U-SHAPED DUCT

(71) Applicant: International Thermal Systems, LLC, Milwaukee, WI (US)

(72) Inventors: John Zea, Oconomowoc, WI (US); Yougui Zhao, Brookfield, WI (US); Dan Bein, New Berlin, WI (US)

(73) Assignee: International Thermal Systems, Inc., Milwaukee, WI (US)

( * ) Notice: Subject to any disclaimer, the term of this patent is extended or adjusted under 35 U.S.C. 154(b) by 223 days.

(21) Appl. No.: 13/803,531

(22) Filed: Mar. 14, 2013

(65) Prior Publication Data

US 2014/0259731 A1 Sep. 18, 2014

(51) Int. Cl.

| | |
|---|---|
| ***F26B 3/04*** | (2006.01) |
| ***F26B 15/10*** | (2006.01) |
| ***F26B 21/00*** | (2006.01) |

(52) U.S. Cl.

CPC . *F26B 3/04* (2013.01); *F26B 15/10* (2013.01); *F26B 21/004* (2013.01)

USPC ..... 34/487; 34/497; 34/105; 34/207; 34/232; 165/104.21; 165/121; 432/207; 432/247; 431/10; 431/326

(58) Field of Classification Search

USPC ..... 34/380, 381, 413, 487, 497, 90, 104, 34/105, 207, 210, 218, 232; 165/104.21, 165/121; 432/207, 247; 431/7, 10, 326

See application file for complete search history.

(56) References Cited

U.S. PATENT DOCUMENTS

| | | | | | |
|---|---|---|---|---|---|
| 3,381,391 | A * | 5/1968 | Yunghahn | 34/105 |
| 3,485,706 | A * | 12/1969 | Evans | 428/134 |
| 3,769,675 | A * | 11/1973 | Chartet | 228/183 |
| 4,052,152 | A * | 10/1977 | Whelan et al. | 432/122 |
| 4,053,993 | A * | 10/1977 | Schregenberger | 34/105 |
| 4,546,553 | A * | 10/1985 | Best | 34/266 |
| 4,662,085 | A * | 5/1987 | Russo et al. | 34/105 |
| 4,677,757 | A * | 7/1987 | Debenham et al. | 34/267 |
| 4,785,552 | A * | 11/1988 | Best | 34/418 |
| 5,353,520 | A | 10/1994 | Gouge et al. | |
| 5,675,913 | A * | 10/1997 | Matsuda et al. | 34/526 |
| 5,749,156 | A * | 5/1998 | Mokler | 34/105 |
| 6,101,739 | A * | 8/2000 | Rutz et al. | 34/373 |
| 6,421,931 | B1 * | 7/2002 | Chapman | 34/424 |
| 7,197,839 | B2 * | 4/2007 | Terazawa et al. | 34/259 |
| 7,963,048 | B2 * | 6/2011 | Pollard | 34/396 |
| 8,186,076 | B2 * | 5/2012 | Takagi | 34/264 |
| 2007/0256320 | A1 * | 11/2007 | Pearson | 34/498 |
| 2010/0298738 | A1 * | 11/2010 | Felts et al. | 600/576 |
| 2011/0252899 | A1 * | 10/2011 | Felts et al. | 73/865.8 |
| 2014/0259731 | A1 * | 9/2014 | Zea et al. | 34/487 |

* cited by examiner

*Primary Examiner* — Steve M Gravini

(74) *Attorney, Agent, or Firm* — Reinhart Boerner Van Deuren s.c.

(57) ABSTRACT

An oven configured for drying a container. The oven includes a housing defining an interior space including a supply chamber and a return chamber. A conveyor is configured for movement within a portion of the interior space of the housing defined by a plurality of semi-circular shaped duct sections connected at each end of the semi-circular shaped duct sections to a straight duct section. Each duct section includes two side walls coupled to a back wall defining a continuous U-shaped duct path through which the conveyor moves. The oven is further configured to provide a temperature difference between any two points within the interior space of the oven housing controlled to plus or minus two degrees Fahrenheit, by a uniform air flow throughout the oven. The uniform air flow is facilitated by the sizing and spacing of various circular orifices and slotted orifices in the continuous duct path.

13 Claims, 4 Drawing Sheets

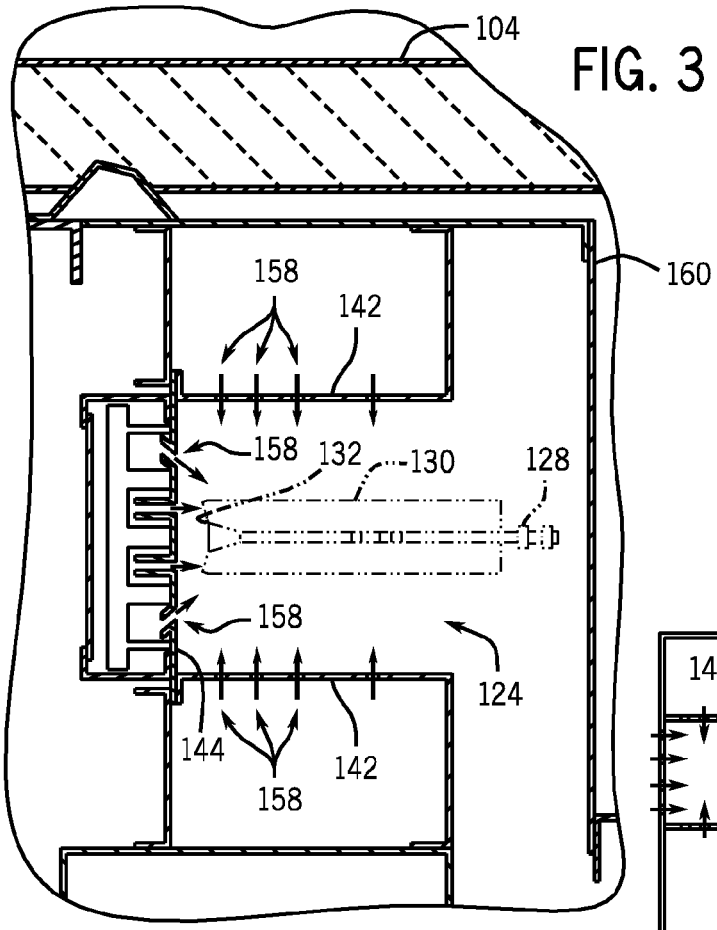
FIG. 3
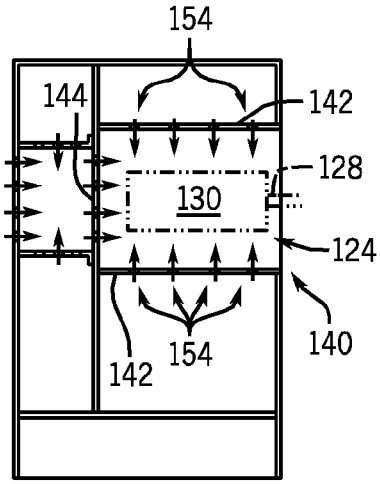
FIG. 5
FIG. 4
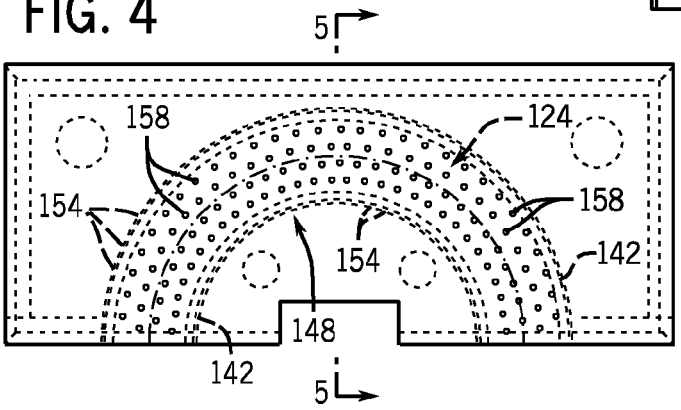

PIN OVEN WITH A CONTINUOUS U-SHAPED DUCT

FIELD OF THE INVENTION

The present invention pertains to ovens, more particularly, to pin ovens for drying open-ended cans.

BACKGROUND OF THE INVENTION

Pin ovens are well known in the art and are widely used in the food and beverage can manufacturing industry for drying the coatings on the exterior of partially completed, open-ended, steel and aluminum cans. The coating applied to the exterior of the cans may include an ink or enamel used to apply the label, an overcoat of lacquer or varnish, or both, a printed label and overcoat.

A typical pin oven includes a conveyor chain mounted for movement in a generally vertical serpentine path defined by a series of straight runs connected by curved sections. Carrier pins are attached to the conveyor chain in spaced relation along its entire length substantially perpendicular to the chain conveyor. The open-ended cans are placed onto the extended pins and are carried over the serpentine path through the oven. Nozzles aligned with the chain path and the cans direct heated air against the outside of the cans as they travel through the oven.

The heated air streams are also intended to stabilize the cans on the chain pins and, therefore, most pin ovens include nozzle arrangements which continuously direct heated air against the can bottoms. Also to facilitate maintaining the cans on the chain pins, pin ovens typically are tipped off vertical center a few degrees. Other prior art patents eliminate can flopping or flutter over the path of movement through the oven by various means.

It is also known to dry inks and finishes applied to the exterior of cans in pin ovens in which the pins include holding apparatus which contact the cylindrical interior of the cans and hold them centered on the pins as the pin chain travels through the oven.

Can manufacturing plants utilize pin ovens typically operating around the clock, seven days per week. Accordingly, energy consumption, both in terms of natural gas used to fuel the air heaters and electricity to operate the blower motors and conveyor motors is very substantial. Thus the ability to process cans in greater volumes with lower time spent in the oven and without increasing air temperature above the desirable maximum, can provide a substantial savings and energy costs. In addition, reducing the amount of natural gas used in the air heaters also substantially lowers the cost of operation as well as reduces gas emissions.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

There is provided an oven configured for drying a container. The oven includes a housing defining an interior space including an air supply chamber and an air return chamber. A conveyor is configured for movement within a portion of the interior space of the housing defined by a plurality of semi-circular shaped duct sections connected at each end of the semi-circular shaped duct sections to a straight duct section. Each duct section includes two sidewalls coupled to a back wall defining a continuous U-shaped duct path through which the conveyor moves.

A plurality of pins are coupled to the conveyor in a spaced-apart relationship and extend perpendicularly from the chain into the U-shaped and straight duct sections. Each pin is configured to support a container.

A plurality of orifices are defined in at least the three walls of each duct section and are in fluid communication with the supply chamber. The orifices are configured to direct air to the container at a velocity of at least six thousand feet per minutes throughout the duct sections of the oven while the containers move along the path.

A solid wall section is coupled to each of the duct sections enclosing the conveyor within each duct section. A motor is coupled to the conveyor and configured to impart movement of the conveyor through each duct section. A heater apparatus is configured to raise the temperature of the air in the supply chamber of the interior space of the housing and an air recirculating mechanism includes a blower coupled to the housing and configured to move the air within the housing from the supply chamber through the plurality of orifices to the return chamber.

In another embodiment, the plurality of orifices include a predetermined combination of elongated slots and circular openings. In some instances the elongated slots include varied longitudinal lengths and varied widths. The configurations of the slots are determined by the designer to assist in maintaining a temperature difference within the oven within predetermined criteria and provide a constant velocity of air through all the orifices. The upper semi-circular shaped duct section and the lower semi-circular duct section defines circular openings in each of the three walls of the U-shaped duct. The straight duct sections of the U-shaped ducts define the plurality of orifices as circular openings in each of the two walls of the straight section and elongated slots in one of the walls of the straight duct section, typically the back wall. In one embodiment, the elongated slots of the one wall of the straight duct section are exposed to the bottom of the cans supported by a pin with at least one slot directed directly perpendicular to the can bottom and at least one other slot directed at an angle less than perpendicular to the bottom of the container.

In another embodiment, the oven is configured to provide a velocity of air directed at the container throughout the continuous duct path at a rate of more than six thousand and one feet per minute and not more than eight thousand feet per minute. In a further embodiment, the oven is configured to provide a temperature difference between any two points within the interior space of the U-shaped duct path controlled to plus or minus two degrees Fahrenheit, by a uniform air flow throughout the oven. The uniform air flow is facilitated by the sizing and spacing of the various circular orifices and slotted orifices in the continuous duct path.

The apparatus of the present invention is of a construction which is both durable and long lasting, and which will require little or no maintenance to be provided by the user throughout its operating lifetime. Finally, all of the aforesaid advantages and objectives are achieved without incurring any substantial relative disadvantage.

DESCRIPTION OF THE DRAWINGS

These and other advantages of the present disclosure are best understood with reference to the drawings, in which:

FIG. 3 is a partial detail view of a portion of the conveyor channel illustrated in FIG. 2 illustrating hot air flow through orifices defined in three walls forming the conveyor channel;

FIG. 4 is a detail of the orifices in an exemplary embodiment of one of an upper curved conveyor channel and a lower curved conveyor channel;

FIG. 5 is a cross-section of the curved conveyor channel illustrated in FIG. 4 along the line 5-5 illustrating orifices in side walls of the channel and in back wall of the conveyor channel;

DETAILED DESCRIPTION OF THE EXEMPLARY EMBODIMENTS

Figure 1:
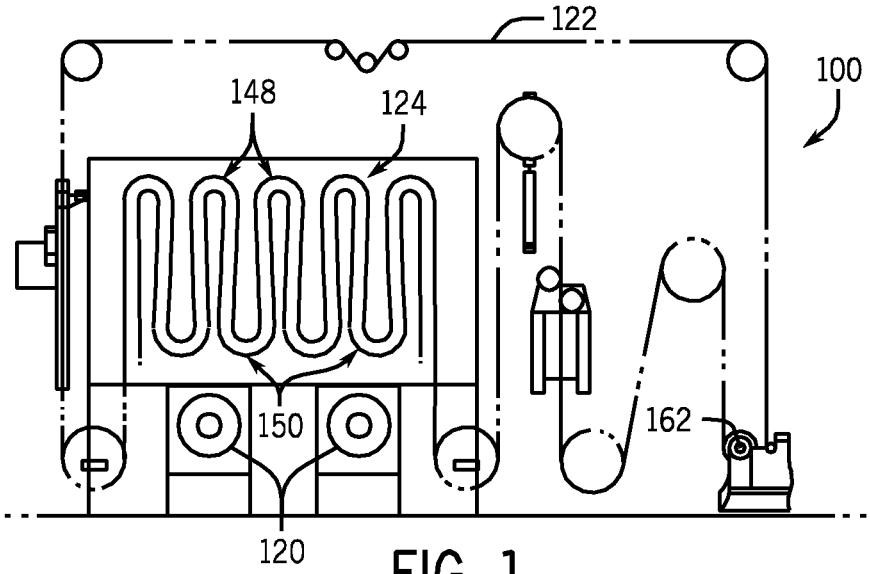
FIG. 1 is a schematic of an exemplary embodiment of a pin oven depicting a conveyor path through the oven.

Referring to FIGS. 1-7, FIG. 1 is a schematic illustration of an exemplary embodiment of a pin oven 100 depicting a conveyor path 124 through the oven 100. A conveyor 122, for example a chain link conveyor is guided through the oven with a series of pulleys and sprockets and driven by a motor 162. A plurality of pins 126 are coupled to the conveyor 122 in a spaced-apart relationship and extending perpendicular from the chain into the oven 100. The chain also moves through other associated equipment (not shown) where containers 130, for example metal cans, are placed on each pin. Inks over varnish are applied to the containers 130 by the equipment outside of the oven 10 and the containers 130 are then moved into the oven for a drying process. The containers exit the oven 100 and move on for further processing.

Figure 6:
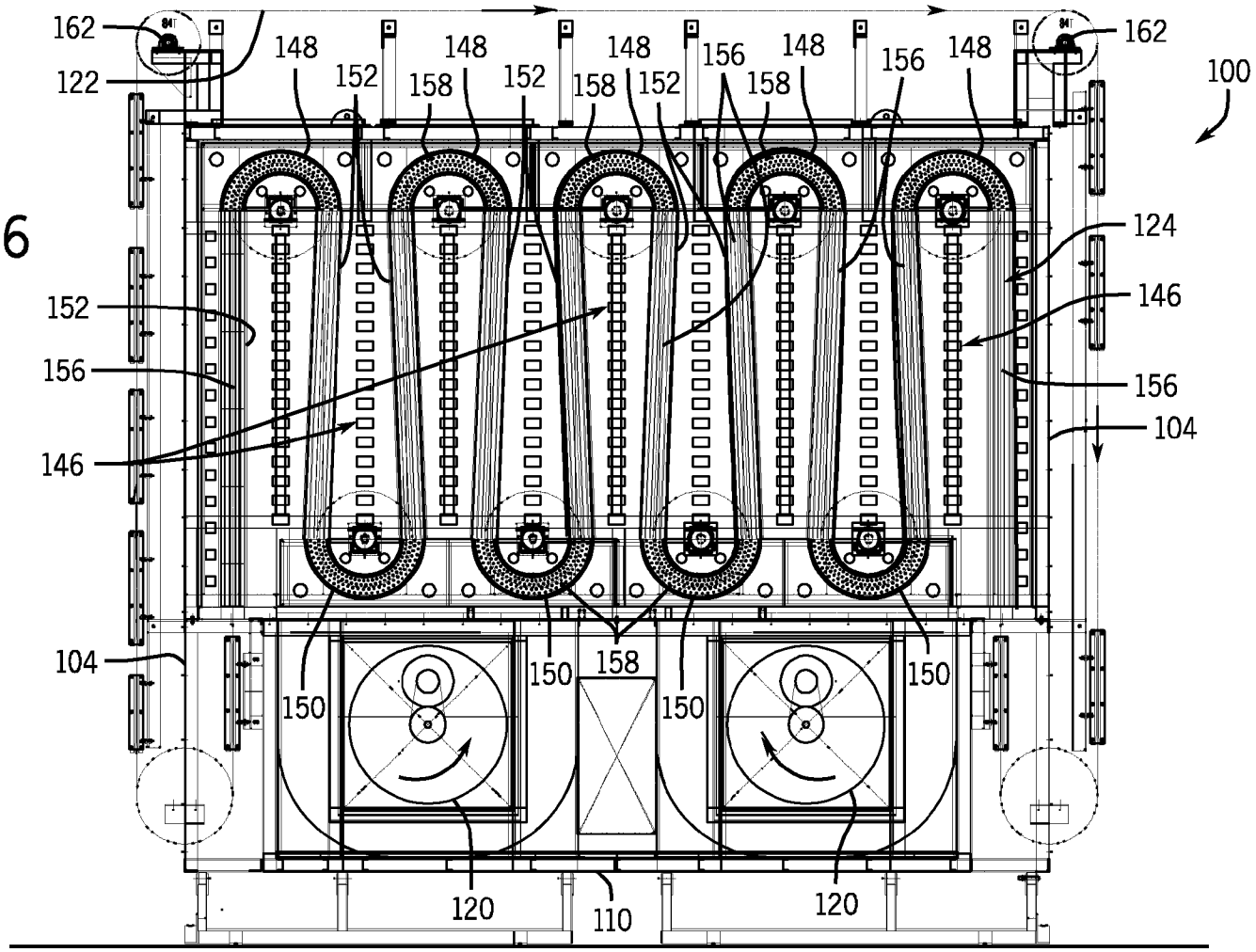
FIG. 6 is a side elevation of the pin oven illustrated in FIG. 1, without the front wall member of the oven, and further illustrating the orifice pattern in the upper and lower conveyor channels and the slots defined in the back wall of the substantially vertical conveyor channel, and further illustrating return air openings defined in oven panels that are in fluid communication with oven burners and blowers.

FIG. 1 and FIG. 6 illustrate what is known as a ten-pass oven since the U-shaped duct path 124 through the oven consists of ten legs. It should be understood that other arrangements are contemplated within the scope of this disclosure.

Figure 2:
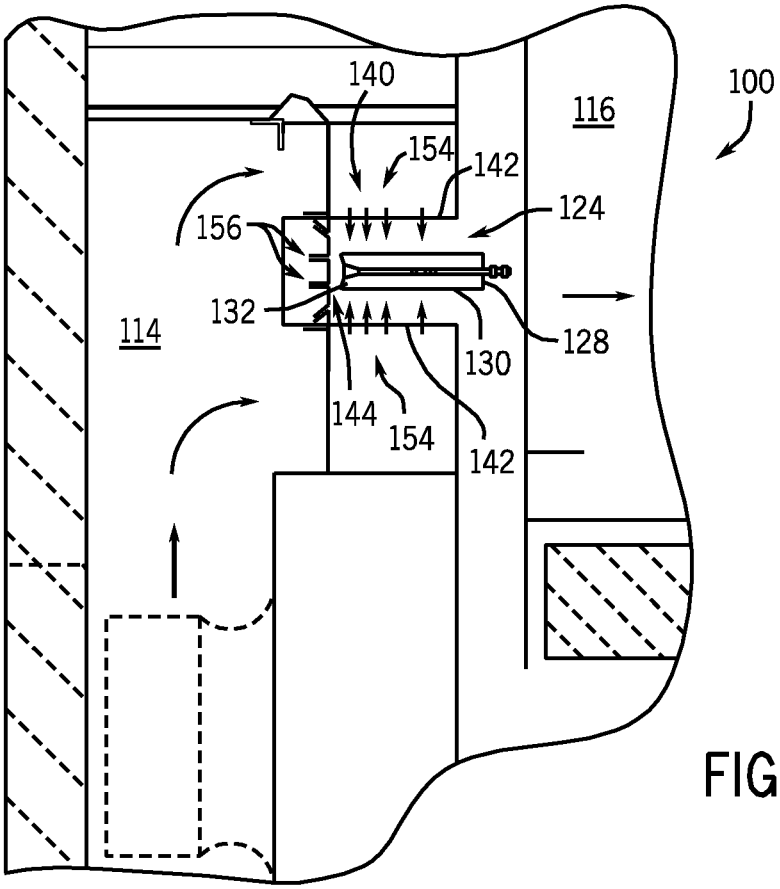
FIG. 2 is a partial view of the pin oven illustrated in FIG. 1 illustrating hot air flow through oven plenums into the conveyor channel and illustrating a container supported by a pin coupled to the conveyor.

FIG. 2 is a partial view of the pin oven 100 illustrated in FIG. 1 illustrating hot air flow through oven plenums into the conveyor channel 124 and illustrating a container 130 supported by a pin 128 coupled to the conveyor 122. A plurality of orifices 154 are defined in side walls 142 and the back wall 144 of the U-shaped duct section 140. In a typical configuration the container 130 is mounted with the bottom of the container 132 positioned inside the U-shaped duct section 140. In such arrangement, the air flow through the plurality of orifices 154 and 156 impinge upon the exterior surface of the container 130.

Hot air, heated by a heater apparatus 118 flows into the supply chamber 114 and into the U-shaped duct path 124 through the plurality of orifices 154 and into the return chamber 116. A blower apparatus 120 is configured to provide a constant velocity of air through all the orifices in the U-shaped duct path 124 in order to provide a temperature difference between any two points within the interior U-shaped duct path space controlled to plus or minus two degrees Fahrenheit. In addition to the blower apparatus 120 the uniform air flow is facilitated by the sizing and spacing of the various circular orifices 158 and sizing and spacing of the various circular orifices 158 and slotted orifices 156 in the U-shaped continuous duct path 124.

It is found that the air flow for drying the container 130, throughout the continuous U-shaped duct path 124, is sufficient at a rate of at least six thousand feet per minute but can be effective at a rate of more than six thousand and one feet per minute, however but not more than eight thousand feet per minute.

It should be understood that the hot air delivery system of the present pin oven 100 maintains the constant air velocity throughout the U-shaped duct path 124, including the upper semi-circular duct section 148, the lower semi-circular duct section 150 and the substantially vertical straight duct sections 152 comprising the U-shaped duct path 124. As illustrated in FIGS. 2, 3, 4, and 5 the various duct sections 148, 150, 152 include a plurality of orifices 154. The plurality of orifices 154 are a combination of elongated slots 156 and circular openings 158. A solid wall section 160 completes the closure of the U-shaped duct path 124 providing high performance air within the U-shaped duct path 124 and maximizing the use of the energy expended to heat the air and move the air through the interior space 112 of the oven 100. The disclosure of the pin oven 100 herein differs from prior art in that prior art provides different air velocities through straight sections, typically holes, and different air velocities in circular orifices. The present disclosure provides a constant velocity in all areas of the U-shaped duct path 124 thereby increasing throughput of the containers in the oven 100 as well as maximizing energy use efficiency.

FIGS. 4 and 5 illustrate an exemplary orifice pattern in an exemplary embodiment of one of an upper curved conveyor duct section 148. A similar arrangement is provided in a lower semi-circular duct section 150. Both the upper and lower semi-circular duct sections 148, 150 are configured similarly. Each end of the semi-circular duct sections are coupled to a substantially vertical straight duct section 152, see FIG. 6. The straight duct sections 152 are configured with an offset from vertical to couple to the end sections of the semi-circular duct sections 148, 150 thereby provide a smooth entry into and out of the semi-circular duct sections 148, 150. Such off-vertical easement into each curved section prevents the containers on the conveyor 122 from binding or moving off a single sprocket associated with each of the semi-circular duct sections 148, 150.

FIG. 5 illustrates a cross-section of a curved conveyor channel, 148, 150 illustrating orifices 154 in each of the side walls 142 of the channel and in the back wall 144 of the U-shaped duct section 140.

FIG. 6 is a side elevation of the pin oven 100 without the front wall member 160. FIG. 6 also illustrates the plurality of orifices 154 in the upper and lower semi-circular conveyor channels 148, 150. In the semi-circular duct sections 148, 150 the orifices are circular in each of the side walls 142 and the back wall 144. In the substantially vertical straight duct sections 152 the plurality of orifices 154 are elongated slots 156. The elongated slots 156 can be one continuous slot defined along the full length of the straight section 152 or can be a series of slots, of different or same length defined in the straight duct section 152. Between each of the straight duct sections 152 are a plurality of openings 146 which are return air openings into the return chamber 116. Hot air is recirculated as the blower apparatus 120 mixes and moves the air through the pin oven 100. As illustrated in FIG. 6, two air blowers 120 are utilized.

Figure 7:
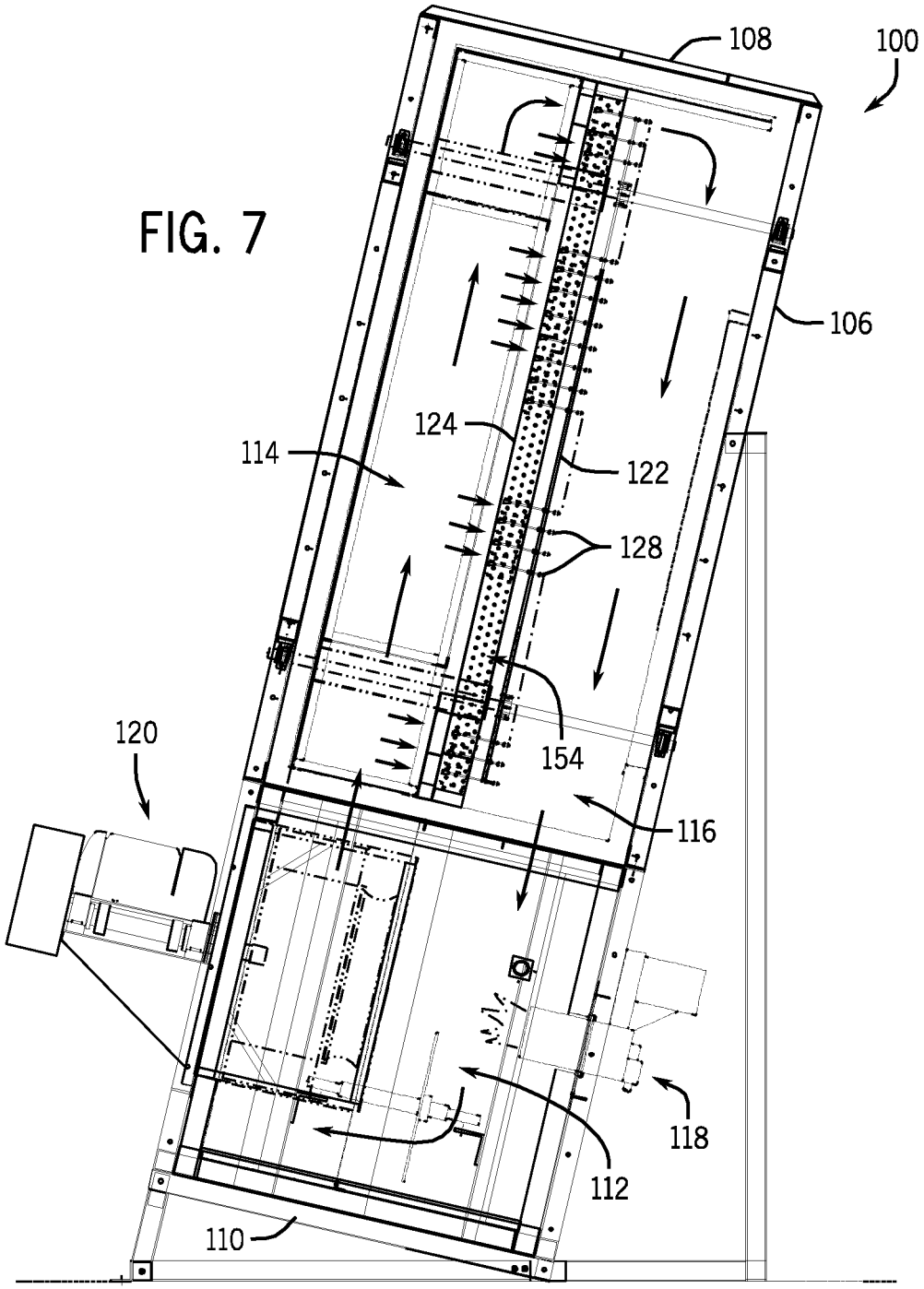
FIG. 7 is an end elevation of the pin oven illustrated in FIG. 6 illustrating air flow through the oven housing and illustrating the conveyor with pins oriented off vertical to facilitate position of a container on a pin coupled to the conveyor.

FIG. 7 is an end elevation of the pin oven 100 illustrated in FIG. 6 illustrating the air flow through the oven housing 102 and illustrating the conveyor 122 with the pins 126 orientated off vertical to facilitate position of a container 130 on a pin 128. The tipping off-center (off vertical) of the oven 100 facilitates maintaining the container 130 on the pin 128. The oven housing 102 includes side housing walls 104, a back housing wall 106, a top housing wall 108, and a bottom housing wall 110. The walls define an interior space 112 through which the conveyor 122 moves in the U-shaped duct path 124 comprised of the several U-shaped duct sections 140 described above. As configured, the pin oven 100 is enclosed with the U-shaped duct path 124 completely covered in the housing 102.

In a typical configuration, the blower apparatus 120 is mounted in the front portion of the oven 100 and the heater apparatus 118 is mounted at the rear of the oven housing 102. In an exemplary embodiment, the blower apparatus 120 can move air at the rate of six thousand feet per minute utilizing an electric three-phase motor providing sixty horsepower.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present mechanism has been shown and described with reference to particular embodiments and applications thereof, it has been presented for purposes of illustration and description and is not intended to be exhaustive or to limit the disclosure to the particular embodiments and applications disclosed. It will be apparent to those having ordinary skill in the art that a number of changes, modifications, variations, or alterations to the mechanism as described herein may be made, none of which depart from the spirit or scope of the present disclosure. The particular embodiments and applications were chosen and described to provide the best illustration of the principles of the mechanism and its practical application to thereby enable one of ordinary skill in the art to utilize the disclosure in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. An oven configured for drying a container, the oven comprising:

a housing defining an interior space including a supply chamber and a return chamber;

a conveyor configured for movement within a portion of the interior space of the housing defined by a plurality of semi-circular-shaped duct sections connected at each end of the semi-circular-shaped duct sections to a straight duct section, wherein each duct section includes two side walls coupled to a back wall defining a continuous U-shaped duct path through which the conveyor moves;

a plurality of pins coupled to the conveyor in a spaced apart relationship and extending perpendicular from the chain into the semi-circular shaped duct sections and straight duct sections, with each pin configured to support a container;

a plurality of orifices defined in at least the three walls of each duct section and in fluid communication with the supply chamber and with the orifices configured to direct air to the container at a velocity of at least six thousand feet per minute throughout the duct sections of the oven while the container move along the path;

a solid wall section coupled to each of the duct sections enclosing the conveyor within each duct section;

a motor coupled to the conveyor and configured to impart movement of the conveyor through each duct section;

a heater apparatus configured to raise the temperature of the air in the supply chamber of the interior space of the housing; and a blower coupled to the housing and configured to move air within the housing from the supply chamber through the plurality of orifices to the return chamber.

2. The oven of claim 1, further comprising the plurality of orifices including a predetermined combination of elongated slots and circular openings.

3. The oven of claim 2, wherein the elongated slots include varied longitudinal lengths and varied widths.

4. The oven of claim 2, wherein the U-shaped duct path sections define the plurality of orifices as circular openings in each of the three walls of an upper semi-circular shaped duct section and a lower semi-circular shaped duct section.

5. The oven of claim 2, wherein the straight duct sections define the plurality of orifices as circular openings in each of two walls of the straight duct section and elongated slots in one of the walls of the straight duct section.

6. The oven of claim 5, wherein the elongated slots of the one wall of the straight duct section is exposed to a bottom of the container supported on a pin.

7. The oven of claim 1, further comprising the velocity of air directed at the container throughout the continuous duct path is more than six thousand and one feet per minute and not more than eight thousand feet per minute.

8. The oven of claim 1, further comprising a temperature difference between any two points within the interior space of the U-shaped duct path is controlled to plus or minus two degrees Fahrenheit, by uniform air flow throughout the oven.

9. The oven of claim 1, wherein the container is a metal can.

10. A method for drying a container in an oven, with the oven including a conveyor supporting pins configured to support the container, the oven further including a heater apparatus and a blower apparatus with such apparatus configured to provide heated air within the oven, the method comprising:

installing a U-shaped duct path within the oven, with the U-shaped duct path comprising:

a plurality of semi-circular shaped duct sections connected at each end of the semi-circular shaped duct sections to a straight duct section with each duct section defining a plurality of orifices configured to direct the heated air into the U-shaped duct path and with the conveyor configured to move through the U-shaped duct path;

enclosing the entire U-shaped duct path with a solid wall section across the open end of the U-shaped duct; and controlling the temperature within the U-shaped duct path by uniform air flow throughout the oven such that a temperature difference between any two points within the interior space of the U-shaped duct path is not more than plus or minus two degrees Fahrenheit, wherein a container moving through the U-shaped duct path, on a pin, is dried by the hot air moving through the plurality of orifices.

11. The method of claim 10, wherein the plurality of orifices includes circular openings and elongated slots.

12. The method of claim 11, further comprising configuring walls of the semi-circular shaped duct sections with defined circular openings and walls of the straight duct sections with both circular openings and elongated slots.

13. The method of claim 10, wherein the uniform air flow is in the range of six thousand and one feet per minute to eight thousand feet per minute in each of the U-shaped duct sections throughout the U-shaped duct path.

* * * * *